US005078766A

United States Patent [19]

Guilleminot

[11] Patent Number: 5,078,766

[45] Date of Patent: Jan. 7, 1992

[54] EQUIPMENT FOR AIR DISTILLATION TO PRODUCE ARGON

[75] Inventor: Odile Guilleminot, Lesigny, France

[73] Assignee: L'Air Liquide, Societe Anonyme Pour L'Etude Et L'Exploitation Des Procedes Georges Claude, Paris, France

[21] Appl. No.: 553,747

[22] Filed: Jul. 16, 1990

[30] Foreign Application Priority Data

Jul. 28, 1989 [FR] France ..... 89 10221

[51] Int. Cl.[5] ..... F25J 3/04

[52] U.S. Cl. ..... 62/22; 62/36; 62/42

[58] Field of Search ..... 62/22, 36, 42

[56] References Cited

U.S. PATENT DOCUMENTS

| | | | |
|---|---|---|---|
| 3,127,260 | 3/1964 | Smith | 62/36 |
| 3,729,943 | 5/1973 | Petit | 62/22 |
| 3,751,933 | 8/1973 | Balabaev et al. | 62/22 |
| 4,575,388 | 3/1986 | Okada | 62/22 |
| 4,747,859 | 5/1988 | Gladman et al. | 62/22 |
| 4,756,731 | 7/1988 | Erickson | 62/22 |
| 4,824,453 | 4/1989 | Rottmann et al. | 62/22 |

FOREIGN PATENT DOCUMENTS

| | | |
|---|---|---|
| 2550325 | 2/1985 | France . |
| 8806705 | 9/1988 | World Int. Prop. O. . |

*Primary Examiner*—Ronald C. Capossela
*Attorney, Agent, or Firm*—Young & Thompson

[57] ABSTRACT

The column for the production of impure argon (2) is surmounted by an auxiliary column section (9) which is cooled to produce reflux by vaporizing poor liquid withdrawn from the head portion of the mean pressure column (3) and expanded. Application to the addition of an argon side column to an air distillation double column.

11 Claims, 1 Drawing Sheet

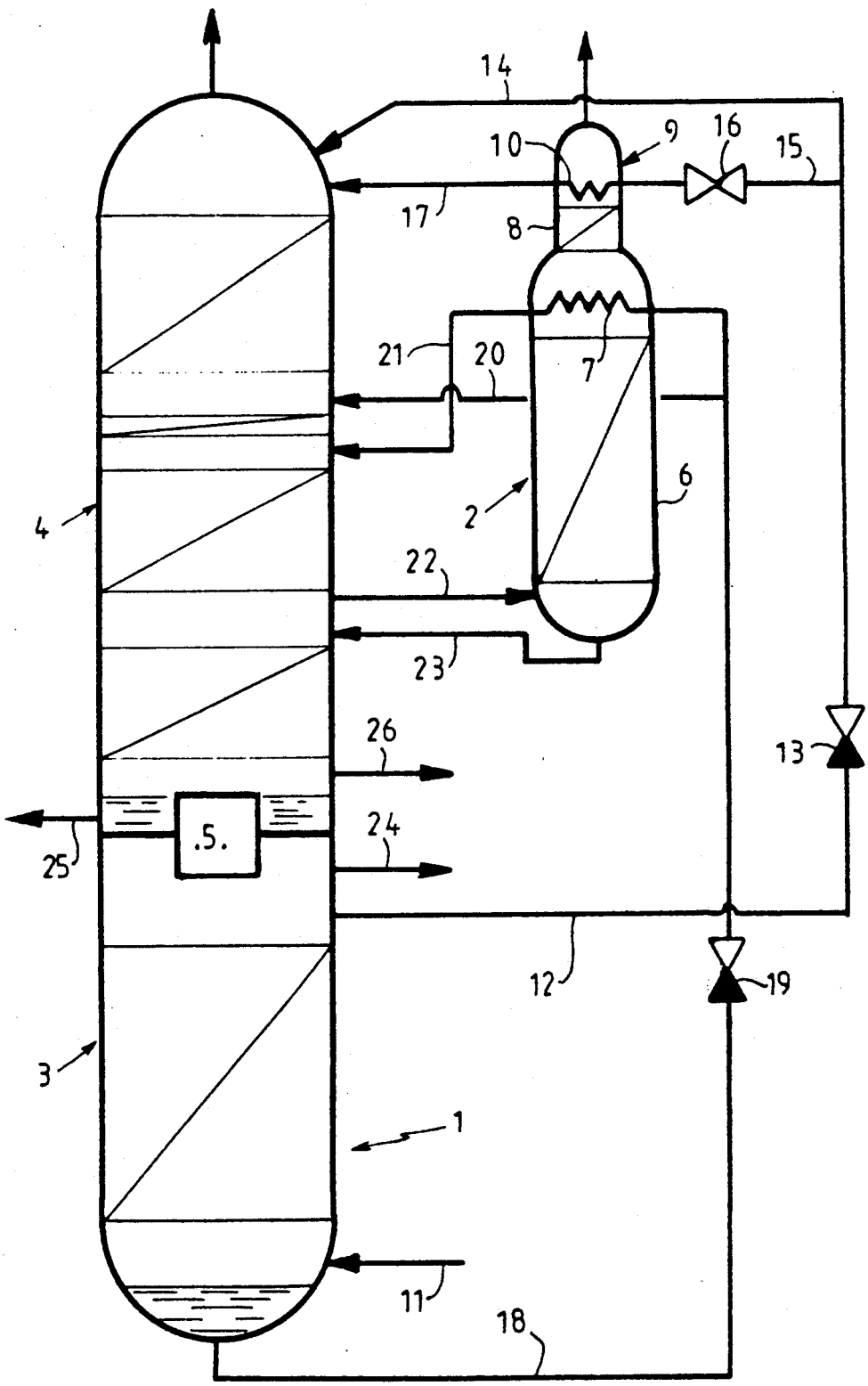
14
10
9
16
15
17
8
21
20
7
6
2
4
22
23
26
13
.5.
24
25
12
19
3
1
11
18

EQUIPMENT FOR AIR DISTILLATION TO PRODUCE ARGON

BACKGROUND OF INVENTION (a) Field of the Invention

The present invention relates to an equipment for air distillation, of the type comprising an air distillation double column which comprises a mean pressure column and a low pressure column, and a column for the production of impure argon connected to the low pressure column and containing a main head condenser cooled by vaporizing expanded rich liquid extracted in the vat portion of the mean pressure column.

(b) Description of Prior Art

The known solution for producing argon consists in withdrawing, through a so-called argon tapping duct located at an intermediate level of the low pressure column, a vapor in which the argon concentration is in the vicinity of 10% and having a low nitrogen concentration (<0.1%). This vapor is sent to the vat portion of a column for the production of impure argon, so-called "mixture column", and is concentrated into its lighter components ($N_2$ + Ar) by contact through plates with a liquid which becomes loaded with oxygen. This liquid is obtained by liquefying a portion of the column head vapor, in a condenser in which the refrigeration is supplied by vaporizing, under low pressure, the rich liquid withdrawn in the vat portion of the mean pressure column, after sub-cooling at about −185° C.

The argon mixture (impure argon) withdrawn in the head portion of the mixture column has a flow about 30 times smaller than the argon tapping flow and has the following typical composition (in moles):

| | |
|---|---|
| $N_2$ | 3% |
| Ar | 95% |
| $O_2$ | 2% |

The vat liquid of the mixture column is sent back to the low pressure column.

The final step for producing pure argon in liquid form consists, in a first stage, to eliminate oxygen in the form of water by catalytic conversion, into a so-called "DEOXO" system, in the presence of excess hydrogen according to the reaction:

$$H_2 + O_2 \rightarrow H_2O$$

After drying, the mixture, which now contains only nitrogen, argon and traces of hydrogen, is cooled down and sent to a distillation column where argon in liquid form is found in the vat and the lighter gas, in the head.

To provide for a good operation of the "DEOXO" system, and also to limit the consumption of hydrogen in this apparatus, the molar concentration of hydrogen in the mixture preferably does not exceed 2 to 3 percent. Moreover, to ensure the reflux of the mixture column, in the condenser, there should be a certain difference of temperature between the rich liquid which is vaporized and the vapor in the column head. Therefore, this head vapor should not be too rich in nitrogen, and consequently the content of tapping nitrogen, which is about 30 times lower because of the very high reflux rate, should be very small. A nitrogen content of the order of 0.1% in tapping argon, which gives 0.1%×30=3% in the argon mixture, is acceptable.

If this condition presents no problem in the designing of new equipment, this is not the case when means for producing argon is to be added to an existing double column in which there is no provision for such addition.

SUMMARY OF INVENTION

The invention aims at enabling, in all cases, equipment with double column to produce argon, subject to a minimum disturbance of the operation of the double column.

For this purpose, it is an object of the invention to provide equipment for distillation of air of the above type, characterized in that it comprises an auxiliary column section provided with an auxiliary head condenser, means for supplying this auxiliary condenser with a second liquid containing less oxygen than the rich liquid, said second liquid being taken in the mean pressure column and expanded, and means to reflux back in the column for the production of impure argon, the vat liquid of said auxiliary section.

BRIEF DESCRIPTION OF DRAWING

An embodiment of the invention will now be described with reference to the annexed drawing, in which, the single FIGURE is a schematic representation of an equipment according to the invention.

DESCRIPTION OF PREFERRED EMBODIMENTS

The equipment represented in the drawing essentially comprises a double column 1 for the distillation of air which is associated with a mixture column 2. The double column comprises a mean pressure column 3, which operates in the vicinity of 6 bars absolute, and is surmounted by a low pressure column 4, which operates slightly above atmospheric pressure. The head vapor (nitrogen) of column 3 is placed in indirect heat exchange relationship with the vat liquid (oxygen) of column 4 by means of a vaporizer-condenser 5.

The mixture column is contained in cylindrical member 6 and is provided with a main head condenser 7. The cylindrical member 6 extends upwardly above condenser 7 into an auxiliary cylindrical member 8 of reduced diameter, which defines an auxiliary distillation section 9 with some theoretical plates, in practice distillation plates or a lining, and provided with an auxiliary head condenser 10.

The air to be separated, from which water and carbon dioxide have been removed, compressed at about 6 bars absolute and cooled in the vicinity of its dewpoint, is introduced at the bottom of the column 3 through a duct 11. Poor liquid, consisting of nearly pure nitrogen, is withdrawn at the top of column 3 through a duct 12 and is expanded in an expansion valve 13. A portion of this poor expanded liquid is refluxed in the top of the low pressure column 4 via a duct 14; the remaining portion is sent into condenser 10 via duct 15, provided with a valve 16, to be vaporized then introduced into column 4 via duct 17.

Rich liquid, consisting of oxygen enriched air, is withdrawn in the vat portion of column 3 through a duct 18 and is expanded in an expansion valve 19. A portion of the expanded liquid is refluxed in column 4 via duct 20, and the remaining portion is sent to condenser 7 to be vaporized therein, then introduced into column 4, via duct 21.

Column 2 is supplied at the base with a vapor taken from an intermediate level of the column 4 by means of an argon tapping duct 22. The vat liquid returns into column 4, substantially at the same level, via duct 23.

A duct 24 for withdrawing mean pressure nitrogen gas and ducts 25, 26 for withdrawing low pressure oxygen in the form of liquid and gas respectively have also been represented in the drawings.

It is believed that the nitrogen content cf the vapor withdrawn from column 4 at the level of the argon tapping 22 is too high to permit the condensation of a mixture containing less than 2% oxygen by means of the expanded rich liquid, this nitrogen content being for example of the order of 1 percent. Such a case may for example take place when an existing double column needs to be completed by means of argon producing means.

With the equipment described above, the essential step in the oxygen-argon separation is carried out in column 2. The nitrogen content in the head portion of this column is the one which corresponds to the temperature of the expanded rich liquid which vaporizes in the main condenser 7, and this nitrogen content is too low with respect to that required by the material present in column 2 for a flow corresponding to the production of an argon mixture. The enriching in nitrogen of the vapor continues in the auxiliary section 9, as a result of the reflux resulting from the vaporization in the auxiliary condenser 10 of expanded poor liquid, this vaporization taking place, after expansion, at a pressure which is substantially the same as that of column 4, at a temperature which is lower than that of main condenser 7. It will be noted that the reflux of column 2 is ensured simultaneously by the liquid which is condensed by the condenser 7, and by the liquid which is produced at the base of section 9.

Of course, the rich liquid and the poor liquid may be sub-cooled, as is known in the art, before being expanded.

As a variant, calculation may establish that it is sufficient to expand the poor liquid at a pressure which is intermediate between those of columns 3 and 4 to produce the reflux of section 9. The condenser 10 is then supplied by means of a duct which is different from duct 12, and is provided with its own expansion valve, and the duct 17 is provided with an additional expansion valve.

Also as a variant, the auxiliary section 9 may be mounted in a cylindrical member which is distinct from cylindrical member 6.

The addition of means of producing argon to an existing double modifies the operating parameters of the latter, sometimes in a manner which is difficult to forecast. Thus, there are limit cases where the real content of nitrogen that will be obtained by argon tapping cannot be established with certainty. In such cases, it si advantageous to provide an auxiliary section 9, starting from the unfavorable hypothesis wherein this nitrogen content will be too high. In operation, if this content is found to be sufficiently low, at least for some operations of the equipment, it is sufficient to close valve 16. The equipment then produces a suitable argon mixture in a known manner, by means of the sole column 2.

I claim:

1. An apparatus for air separation by rectification, comprising:

a first column having a top portion and a bottom portion, a second column having a top portion and a bottom portion, and an argon column having a bottom portion in fluid exchange relationship with the second column, the first column having feed means for introducing into said first column air to be separated, first outlet means for withdrawing a first liquid which is enriched in oxygen and second outlet means for withdrawing a second liquid which is less rich in oxygen than the first liquid;

the argon column having a main section, a first head condenser in heat exchange relation with the main section and supplied with said first liquid, and a second head condenser supplied with said second liquid.

2. The apparatus of claim 1, wherein said second head condenser is in heat exchange relation with an upper column section of the argon column which is above said main section.

3. The apparatus of claim 2, wherein the upper column section has a diameter less than the main section.

4. The apparatus of claim 2, wherein the second outlet means are provided at the top portion of the first column.

5. The apparatus of claim 4, wherein the second head condenser has outlet means connected via a duct to inlet means at the top portion of the second column.

6. The apparatus of claim 5, comprising a second duct means between said second outlet means and the second head condenser, the second duct means including at least one second expansion means for expanding the second liquid supplied to the second head condenser.

7. The apparatus of claim 6, comprising a branch line between the second duct means and the top portion of the second column.

8. The apparatus of claim 1, comprising first duct means between said first outlet means and the first head condenser, the first duct means including a first expansion means for expanding the first liquid supplied to the first head condenser.

9. The apparatus of claim 1, wherein the first outlet means are provided at the bottom of the bottom portion of the first column.

10. The apparatus of claim 1, wherein said first and second head condensers are both located within said argon column and said second head condenser is spaced above said first head condenser.

11. The apparatus of claim 10, there being means defining theoretical distillation plates between said first and second head condensers and below said first head condenser within said argon column.

* * * * *